US009055774B2

(12) United States Patent
Gambordella

(10) Patent No.: US 9,055,774 B2
(45) Date of Patent: Jun. 16, 2015

(54) SPORTS GLOVE WITH GRIPPING POWER

(76) Inventor: Ted Gambordella, Dallas, TX (US)

( * ) Notice: Subject to any disclaimer, the term of this patent is extended or adjusted under 35 U.S.C. 154(b) by 413 days.

(21) Appl. No.: 13/066,267

(22) Filed: Apr. 11, 2011

(65) Prior Publication Data

US 2012/0204319 A1 Aug. 16, 2012

Related U.S. Application Data

(60) Provisional application No. 61/441,685, filed on Feb. 11, 2011.

(51) Int. Cl.
*A41D 19/015* (2006.01)
*A63B 71/14* (2006.01)

(52) U.S. Cl.
CPC ..... *A41D 19/01547* (2013.01); *A63B 71/141* (2013.01); *A63B 2209/10* (2013.01); *A63B 71/148* (2013.01)

(58) Field of Classification Search
CPC ... A63B 71/146; A63B 2209/10; A41D 19/00
USPC ..... 2/161.2, 161.1, 160, 159, 163, 16, 19, 2/161
See application file for complete search history.

(56) References Cited

U.S. PATENT DOCUMENTS

| | | | | | |
|---|---|---|---|---|---|
| 1,885,572 | A * | 11/1932 | Wood | 601/137 |
| 2,884,644 | A * | 5/1959 | Jefferson | 2/158 |
| 2,928,102 | A * | 3/1960 | Canausa | 2/161.2 |
| 3,740,766 | A * | 6/1973 | Kobylarz | 2/161.2 |
| 5,113,530 | A * | 5/1992 | Smith | 2/19 |
| 5,138,718 | A * | 8/1992 | Willard | 2/159 |
| 5,367,711 | A * | 11/1994 | Calagui | 2/161.6 |
| 5,590,421 | A * | 1/1997 | Craner | 2/161.7 |
| 5,715,539 | A * | 2/1998 | Benecki et al. | 2/160 |
| 5,765,228 | A * | 6/1998 | Bieling | 2/158 |
| 6,212,687 | B1 * | 4/2001 | Kwon | 2/161.3 |
| D446,610 | S * | 8/2001 | Rosenberg | D29/116.2 |
| 6,275,996 | B1 * | 8/2001 | Redwood et al. | 2/160 |
| 6,745,403 | B2 * | 6/2004 | Sajovic | 2/161.8 |
| 8,205,269 | B2 * | 6/2012 | Anderson | 2/161.2 |
| 2008/0282445 | A1 * | 11/2008 | Taliento et al. | 2/161.3 |
| 2009/0183295 | A1 * | 7/2009 | Rhee | 2/161.2 |
| 2011/0041235 | A1 * | 2/2011 | Harris | 2/161.1 |
| 2011/0113521 | A1 * | 5/2011 | Bradford | 2/19 |

* cited by examiner

*Primary Examiner* — Richale Quinn
(74) *Attorney, Agent, or Firm* — Ushas Koshy

(57) ABSTRACT

A sports glove that increases grip strength to enhance an athlete's performance in any sport. The increase in grip strength generated by the Vpower sports glove of the invention is brought about by sewing the index finger and middle finger together and the ring finger and pinky finger together so that the pairs of fingers act as one finger. Another embodiment of the Vpower glove employs a hook and loop tape arrangement to bind the pairs of fingers together so that they act as one to increase the gripping power of the glove. The Vpower glove forces the wearer to use the power of two fingers on every grip and immediately increases the gripping strength of the wearer without any additional effort and this increase in grip strength is permanent.

7 Claims, 7 Drawing Sheets

SPORTS GLOVE WITH GRIPPING POWER

CROSS REFERENCE TO RELATED APPLICATION

This application claims priority under 35 USC 119(e) to U.S. Provisional Patent Application Ser. No. 61/441,685 filed on Feb. 11, 2011, which is incorporated herein by reference in its entirety.

FIELD OF THE INVENTION

The present invention generally relates to sports gloves. More particularly, the invention relates to a sports glove designed to increase and maximize the grip strength of an athlete to improve athletic performance in a variety of sports.

BACKGROUND OF THE INVENTION

The use of gloves in sports is well known in the art. The type of glove used in a sport depends on the particular sport whether it is football, baseball, golf, tennis, soccer, hockey, martial arts, wrestling, cycling or other sports. The design and construction of sports gloves for each sport is focused mainly on protecting the athlete's hands from injury when catching or throwing a ball, swinging a racquet, lifting weights, throwing punches etc. A majority of sports gloves also focus on enhancing the grip of the glove by applying sticky material such as rubber or other synthetic material to the catching surface of the glove to improve tackiness and aid in the gripping function whether it is for catching a ball or holding a bat, a racquet, or a golf club. Some grip enhancing sport gloves in the prior art have suction cups attached to the catching surface of the glove as described in U.S. Pat. No. 6,675,392 (Albert); U.S. Pat. No. 6,526,593 and U.S. Pat. No. 6,745,403 (Sajovic).

More important than the tackiness and stickiness of the catching surface of a sports glove is the ability of the glove to provide grip strength which has a significant impact on an athlete's performance. In general, gloves that increase grip strength enhance athletic performance. None of the artificially generated gripping surfaces of sports gloves in the prior art assist with increasing the grip strength of the athlete which is critical to the athletes performance.

Sports gloves in the prior art with other grip enhancing features include the use of springs sewn into the glove overlying each of the user's fingers to impose a selective gripping force as described in U.S. Pat. No. 4,675,914 (Mitchell) or a glove incorporating an elastic strap through which various tension forces can be applied for imposing an auxiliary gripping force on the individual fingers of the user, the force being adjustable while wearing the glove as described in U.S. Pat. No. 4,796,306 (Mitchell). By selectively applying gripping force to each finger of the user of the glove, these prior art gloves do not necessarily increase the overall grip strength of the athlete which is required to improve athletic performance.

When each finger of a traditional or prior art glove works independent of the other fingers, the gripping strength of individual fingers is very weak. When a normal glove is worn in any sport, the fingers work independently and therefore, when catching a ball, tackling, holding a bat or engaging the glove in other activity that requires gripping strength, the player's grip is significantly weaker because they are not utilizing their full gripping strength potential because they often try to hold a bat, catch a ball or make a tackle with only one finger and the grip strength of one finger is very small.

When an object is held simultaneously with two fingers, the two fingers work as one, resulting in the generation of greater grip strength. The increase in grip strength is double or significantly more powerful than just trying to grip with one finger. A traditional glove does not enhance grip strength because all five fingers of the hand are separated and therefore the ability to have two fingers work as one when holding an object is substantially limited.

The present invention, the "Vpower" glove overcomes the deficiency in the prior art for sports gloves that increase grip strength. The increase in grip strength for the sports glove of the present invention is generated by the use of two fingers of the hand working as one when using the glove. In order for the sports glove of the present invention to facilitate the use of two fingers working as one to enhance grip strength, two sets of double fingers are created by sewing the index finger and middle finger of the glove closely together and the ring finger and the pinkie finger closely together such that each pair of fingers acts like one finger. When wearing the resulting glove, the user is forced to use the connected fingers as one forger, thus increasing the gripping strength and full use of the maximum possible gripping power.

Prior art conceiving the concomitant use of two or more fingers together include, U.S. Pat. No. 7,431,657 (Whitehead, II et al.) which describes a grip-enhanced sports glove for bowling that uses an elastomeric, control/grip-enhancing material that circumferences the finger tips of at least one finger providing a similar shape and feel to the commonly used cylindrical insert grips. US Pat. Appl. Pub. No. 2009/0025120 (Vestling) describes a tri-finger multi sport glove covering the index finger, middle finger, thumb and a portion of the wrist of a hand.

More particularly, prior art that describes the concept of stitching together glove fingers include, U.S. Pat. No. 5,628,068 (DeLong) and US Pat. Appl. No. 2008/0282445 (Taliento et al.). U.S. Pat. No. 5,628,068 to DeLong is a two fingered baseball glove with the index and the middle finger joined by a web sewn into the center line of both fingers in a three-panel stitch and primarily serves to train the fingers to remain in the proper pitching position. US Pat. Appl. Pub. No. 2008/0282445 to Taliento et al. provides inserts between the fingers of the glove, webbing the fingers together and spacing them apart and alternatively one or more inserts provided at least between two of the fingers spacing the fingers apart without webbing to improve the grip of the user and absorption of shock. Neither of these patents envisions sewing two fingers of a glove together to act as one finger to increase grip strength as the present invention does.

SUMMARY OF THE INVENTION

The present invention is a sports glove that provides immediate increase in grip strength when worn by an athlete. The increase in grip strength is achieved through the use of two pairs of fingers of the glove acting as one, forcing all gripping to be done with two fingers simultaneously. The benefits of the immediate increase in grip strength when the glove is worn are significant and enhance the performance of every athlete that requires a strong grip for playing their sport.

In an exemplary embodiment of the present invention, the glove index finger and the glove middle finger are attached together starting at their bases all the way to their tops to act as one finger and the glove ring finger and the glove pinky finger are attached together starting at their bases all the way to their tops to act as one finger.

In a modification of the exemplary embodiment of the invention, the index finger and middle finger form one finger till past the middle knuckle sections where they are separated to form two fingers. In this embodiment of the invention, the ring finger and pinky fingers form one finger till past the middle knuckle sections where they are separated to form two fingers.

In yet another embodiment of the present invention, a modification of the V power glove allows the fingers to be held together in groups of two by means of a hook and loop tape arrangement. In this embodiment of the Vpower glove, the pairs of index finger and middle finger and the ring finger and pinky finger are held together by means of a hook and loop tape arrangement.

In all the embodiments of the Vpower glove of the present invention, the wearer of the glove is forced to use the power of two fingers acting as one on every grip and experiences an immediate increase in gripping strength without exerting any additional effort. The improvement in gripping power is immediate and permanent while the glove is worn and will always allow for full gripping power in all circumstances while wearing the glove. In all embodiments of the invention, while the wearer is forced to use two fingers as one, the control of the tips of the fingers is also maintained to allow for the ends of the fingers to grasp and hold any object.

The increase in gripping strength and control when wearing the Vpower sports glove can be experienced for each sport when a standard glove is replaced by the Vpower glove. For instance, in Baseball, the Vpower glove does not allow the little finger to weaken its grip as it happens when using a standard baseball glove and forces the grip to remain strong during the execution of the swing giving the player much greater control of their bat throughout all stages of their swing. In the game of Football, when catching a ball, the Vpower glove gives the receiver the full power of their grip and does not allow the player to try to catch the ball with only one finger or a few fingers. With prior art gloves, a foot ball player often misses a tackle because their grip is weak allowing the receiver to escape, or continue their attack on the ball carrier because the player tries to make the tackle with only one finger or several fingers, but with each finger working a part. The Vpower glove causes the fingers to work together in groups of two to give full strength in every tackle.

In the game of soccer, the use of the Vpower glove with the power of two fingers working together enhances the goalies ability to stop, catch and control the soccer ball. In Golf, the Vpower glove gives the player the full grip strength throughout the entire swing of the club and provides the assurance of the golf club not slipping in their hands when making the swing and greater control of all shots. In Tennis, players often have to use two hands on their backhand stroke because they cannot hold the tennis racket strong in one hand because the force of the ball strike opens the grip of the hand. The Vpower glove provides the full grip strength by forcing two fingers to hold the tennis racket, giving full gripping power with each stroke. In Cycling, including Motorcycling, the use of one finger to pull the clutch when shifting gears numerous times causes significant finger fatigue. The Vpower glove always forces the cyclist to use two fingers on every shift and allows for maximum grip on every shift, without any additional effort providing the cyclist greater control of the shifter and greater control of the cycle or motorcycle.

The embodiments of the Vpower glove of the present invention also have application in Martial Arts where the use of grip strength is required to grab someone in a sparring match without letting them get away and in wrestling to hold and control an opponent. The use of the Vpower glove also provides immediate gripping strength in other work activities requiring a strong grip such as carpentry, digging, swinging an ax or hammer, holding, drilling and many more that require a firm grip to do more effective work.

A further application of the embodiments of the present Vpower glove invention is rehabilitation of the grip lost due to stroke or injuries to the hand. For example a stroke victim with a partially paralyzed hand who is not able to work all his fingers is able to hold training and rehabilitation equipment that requires a firm grip, by wearing the Vpower glove which forces the user to always use two fingers and provides the grip strength required to hold the equipment.

These and other features and advantages of the embodiments of the present invention will become obvious to one skilled in the art when reviewed in conjunction with the ensuing description of the drawings, detailed description of the invention and the claims that follow.

DETAILED DESCRIPTION OF THE INVENTION

The present invention is a sports glove that is designed to provide increase and maximization of grip strength to the athlete and enhance performance when playing any sport. The Vpower glove of the present invention accomplishes the increase in grip strength when worn through the forceful use of two fingers together when catching a ball, swinging a bat, racquet or golf club or in other sports which require a strong grip with the use of a sports glove.

Figure 1:
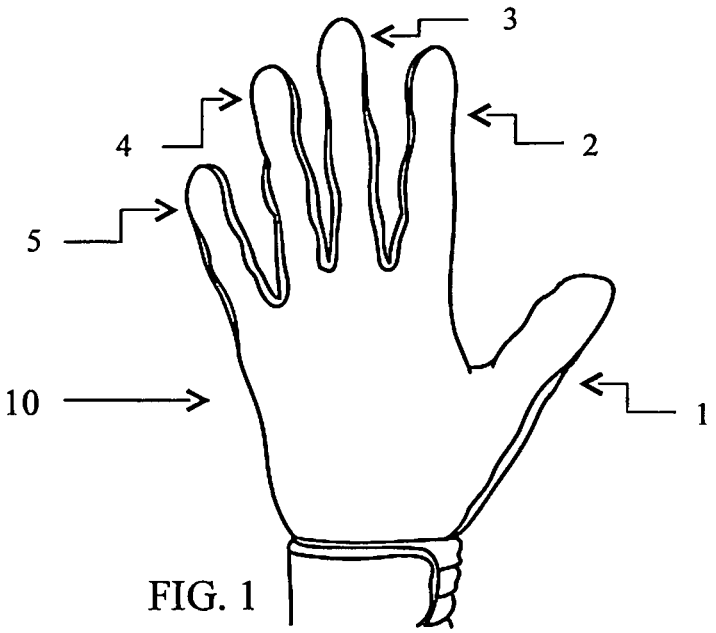
FIG. 1 is a plan view of the back side of a traditional sports glove.
Figure 2:
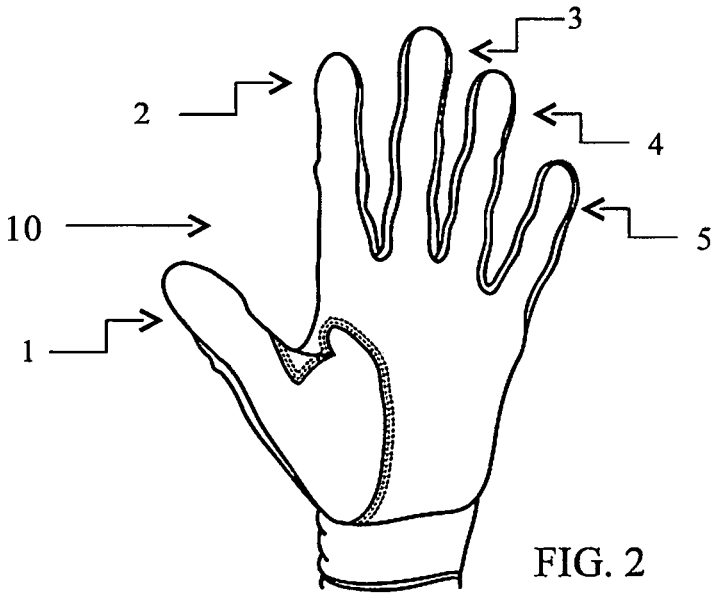
FIG. 2 is a plan view of the front gripping surface of a traditional sports glove.

Referring now to the figures, FIG. 1 and FIG. 2 are the back and front views of a traditional sports glove 10 showing the separated fingers of the hand, thumb 1, index finger 2, middle finger 3, ring finger 4, and pinky finger 5. Each of these fingers of a traditional glove work independently of each other and therefore the gripping strength of each finger is very weak. A player using a traditional glove has a weaker grip because of the use of a single finger to catch a ball, hold a bat, or make a tackle during a game. The Vpower glove of the present invention makes full use of all fingers and is designed and constructed to increase grip strength by forcing the index and middle fingers and the ring and pinky fingers to work together as one.

Figure 3:
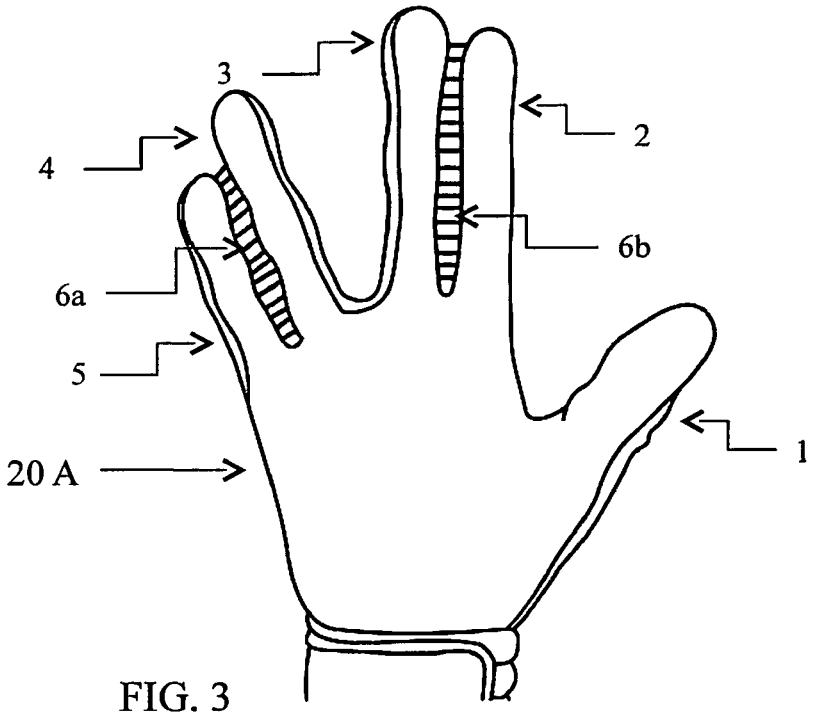
FIG. 3 is a perspective view of the back side of an exemplary embodiment of the Vpower glove of the present invention with the index and middle fingers of the glove attached from the base ends of the fingers to their top ends by means of stitches and held substantially together to act as one finger and the ring and pinky fingers of the glove attached from the base ends of the fingers to their top ends by means of stitches and held substantially together to act as one finger.
Figure 4:
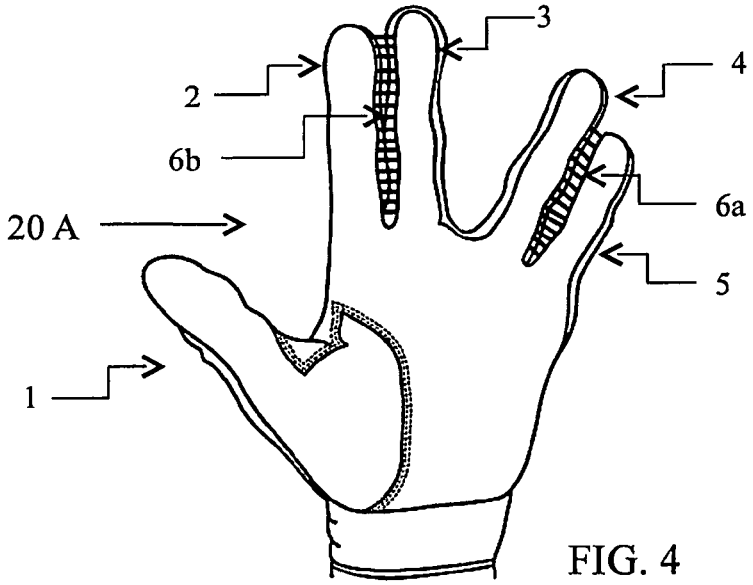
FIG. 4 is a perspective view of the front gripping surface of an exemplary embodiment of the Vpower glove of the present invention with the index and middle fingers of the glove attached from the base ends of the fingers to their top ends by means of stitches and held substantially together to act as one finger and the ring and pinky fingers attached from the base ends of the fingers to their top ends by means of stitches and held substantially together to act as one finger

FIG. 3 and FIG. 4 show the back and front views 20A of an exemplary embodiment of the Vpower glove of the present invention. In, both views, the glove index finger 2 and the glove middle forger 3 can be seen attached together from the base of those glove fingers to the tops of those glove fingers by means of stitches 6*a*. Similarly, the glove ring finger 4 and the glove pinky finger 5 are attached together from the base of those fingers to the tops of those fingers by means of stitches 6*b*. By attaching the first two fingers and the last two fingers of the gloves together in this manner, the wearer of the glove is forced to use the two fingers attached together as one while at the same time maintaining control of the tips of the fingers for catching objects whether a ball, a bat or other sport equipment.

Figure 5:
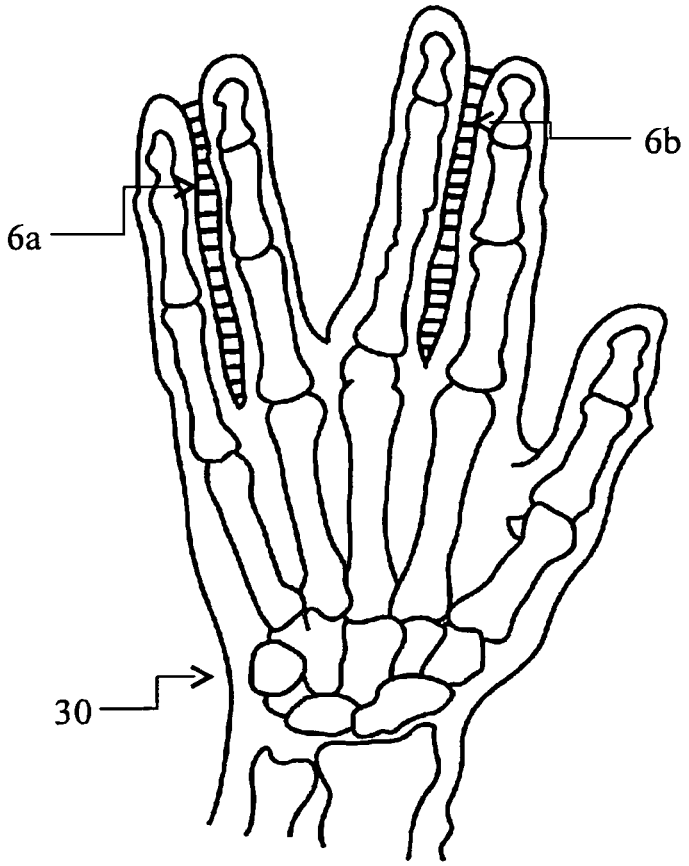
FIG. 5 shows the skeletal view of the bones of the hand and fingers when wearing the exemplary embodiment of the Vpower glove of the present invention when the index and middle glove fingers and the ring and pinky glove fingers are attached together from the bottom of the glove fingers all the way to the top of the glove fingers.

FIG. 5 shows the skeletal view 30 of the bones of the hand and fingers when wearing the exemplary embodiment of the Vpower glove of the present invention when the index and middle glove fingers and the ring and pinky glove fingers are attached together from the bottom of the glove fingers all the way to the top of the glove fingers through stitches 6*a* and 6*b*.

Figure 6:
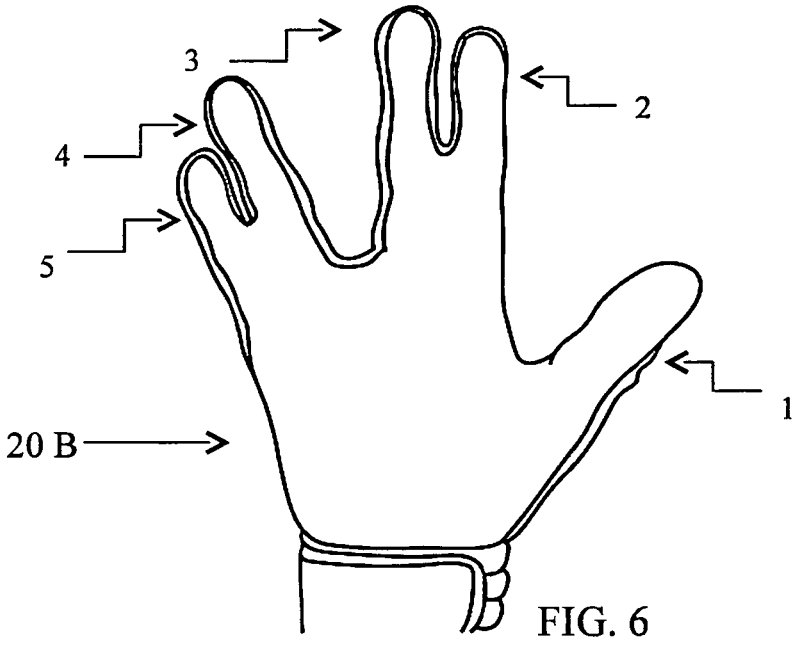
FIG. 6 is a perspective view of the back side of a modified Vpower glove of the present invention with the index and middle glove fingers forming one finger till past the middle knuckle sections where they are separated to form two fingers, and the ring and pinky glove fingers forming one finger till past the middle knuckle sections where they are separated to form two fingers.
Figure 7:
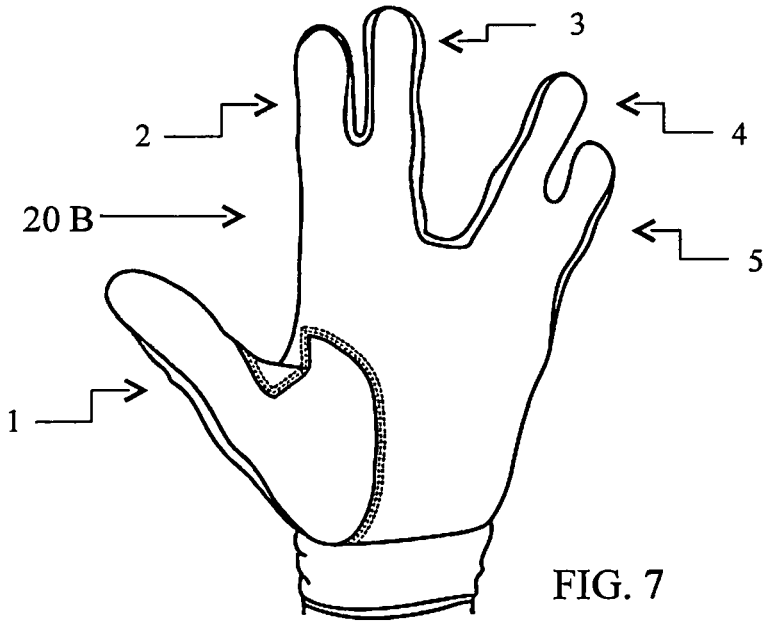
FIG. 7 is a perspective view of the front gripping surface of a modified Vpower glove of the present invention with the index and middle glove fingers forming one finger till past the middle knuckle sections where they are separated to form two fingers, and the ring and pinky glove fingers forming one finger till past the middle knuckle sections where they are separated to form two fingers.

FIG. 6 and FIG. 7 are perspective views of the back and the front gripping surface of a modified Vpower glove of the present invention with the glove index finger 2 and the glove middle finger 3 forming one finger till past the middle knuckle sections where they are separated to form two fingers, and the glove ring finger 4 and the glove pinky finger 5 forming one finger till past the middle knuckle sections where they are separated to form two fingers. This embodiment of the glove, forces the two pairs of fingers to act as one when the glove is worn, to increase the grip strength of the wearer.

Figure 8:
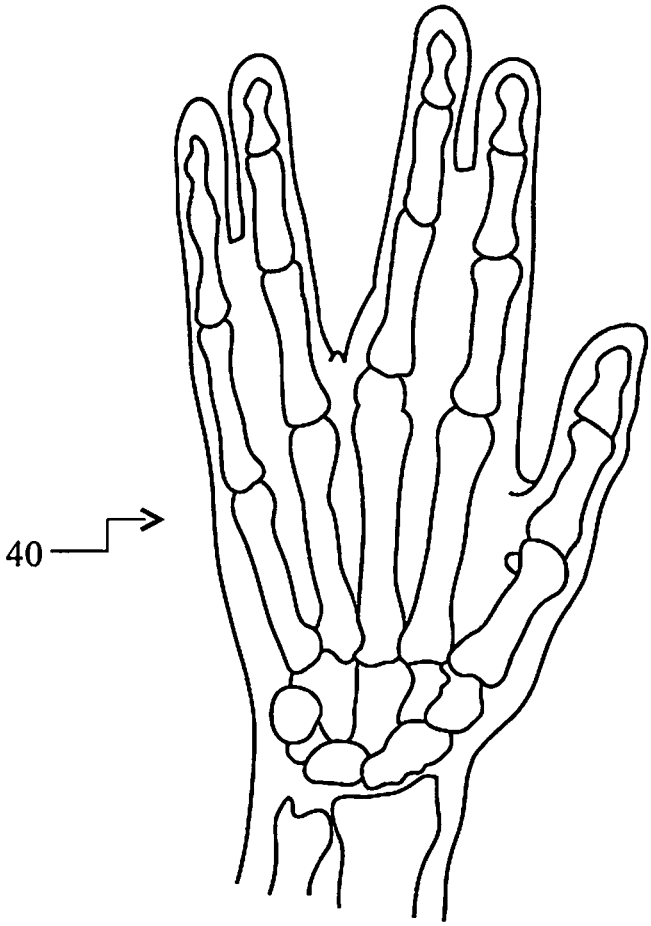
FIG. 8 is a skeletal view of the hand and fingers when wearing the modified Vpower glove of the present invention with the index and middle glove fingers and the ring and pinky glove fingers form one finger till past the middle knuckle sections where they are separated to form two fingers.

FIG. 8 is a skeletal view 40 of the hand and fingers when wearing the modified Vpower glove of the present invention with the index and middle fingers and the ring and pinky fingers of the glove forming one finger till past the middle knuckle sections where they are separated to form two fingers.

Figure 9:
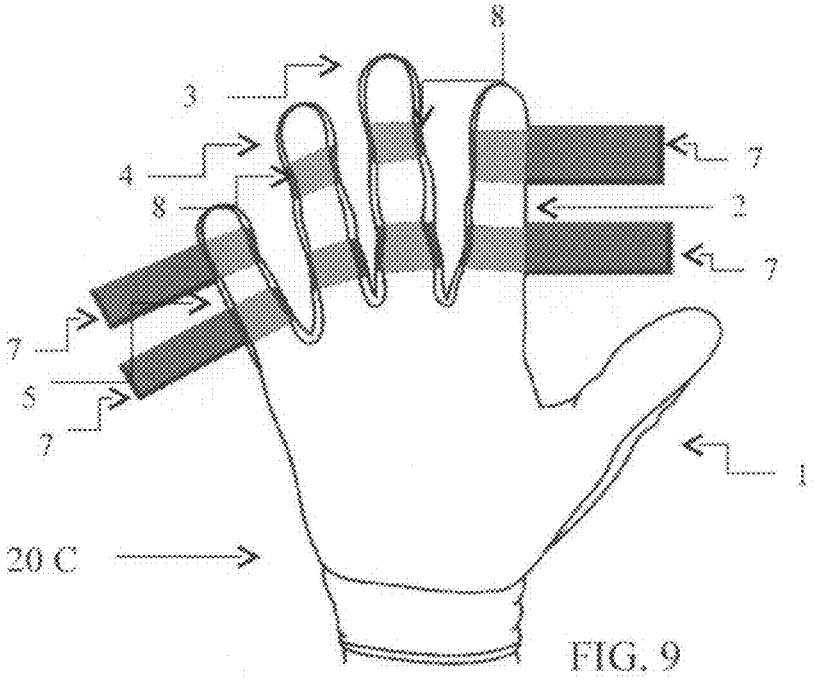
FIG. 9 is a perspective view of the back of yet another modification of the Vpower glove of the present invention showing the use of a hook and loop tape arrangement on the glove fingers to bind them together to form the pairs of the index and middle fingers and the ring and pinky fingers.
Figure 10:
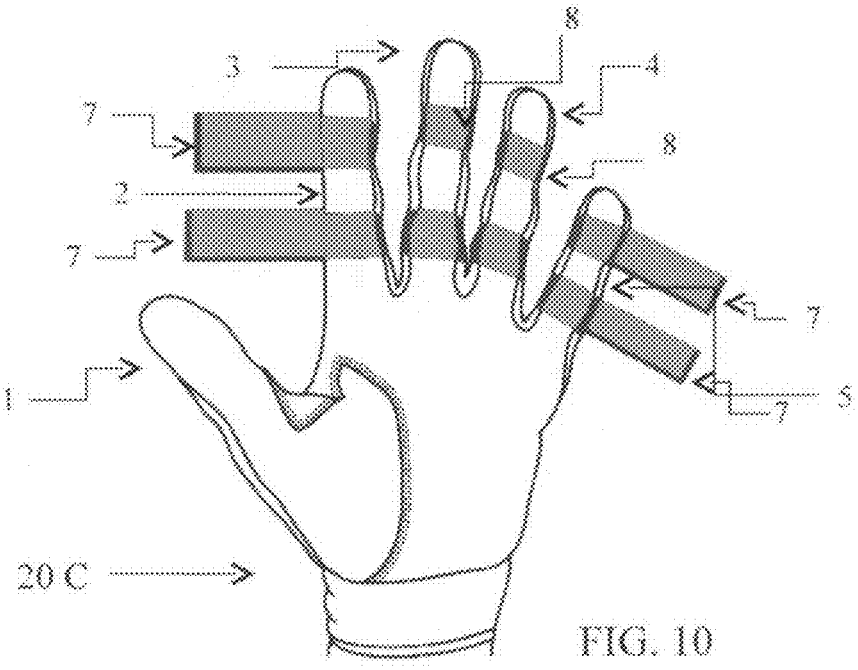
FIG. 10 is a perspective view of the front gripping surface of yet another modification of the Vpower glove of the present invention showing the use of a hook and loop tape arrangement on the glove fingers to bind them together to form the pairs of the index and middle fingers and the ring and pinky fingers.

FIG. 9 and FIG. 10 show detailed views of the back and front gripping surface of yet another modification 20D of the Vpower glove of the present invention showing the use of a hook and loop tape arrangement on the fingers to bind them to form the pairs of the index and middle fingers and the ring and pinky fingers. The figures show the loop 7 extended out from the index finger 2 and pinky finger 5 and the hook 8 positioned on the middle finger 3 and ring finger 4.

Figure 11:
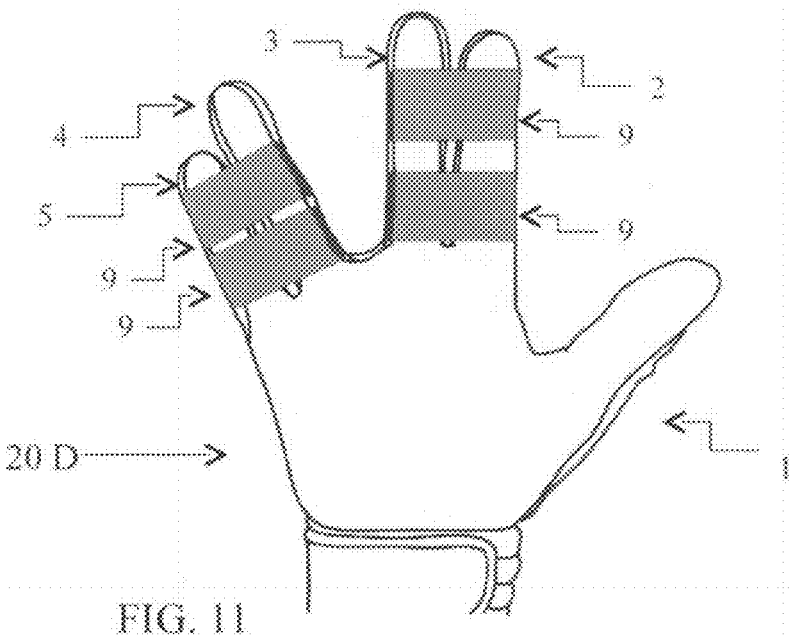
FIG. 11 is a perspective view of the back of the modified Vpower glove showing the structure of the glove fingers when the hook and loop tape arrangement is employed to bind the index and middle glove fingers together and the ring and pinky glove fingers together.
Figure 12:
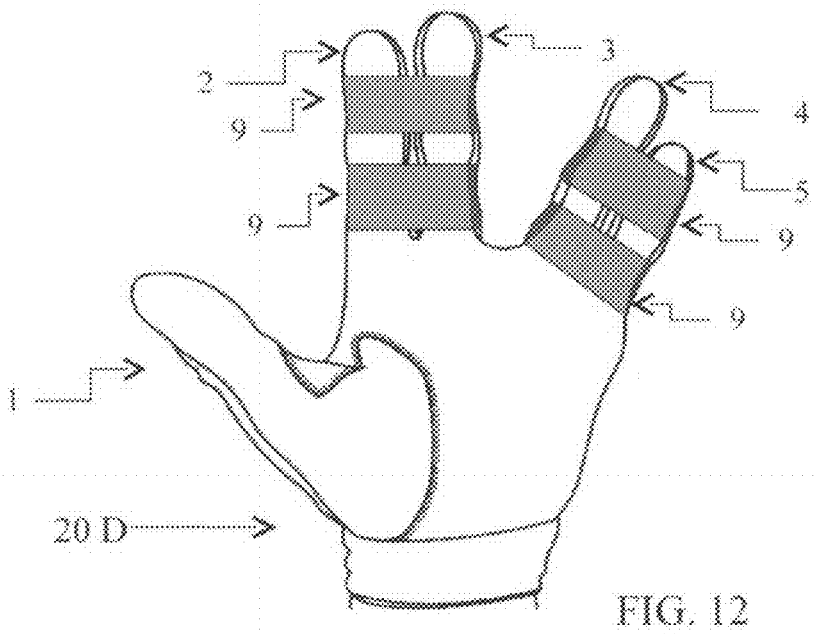
FIG. 12 is a perspective view of the front gripping surface of the modified Vpower glove showing the structure of the glove fingers when the hook and loop tape arrangement is employed to bind the index and middle glove fingers together and the ring and pinky glove fingers together.

FIG. 11 and FIG. 12 show the back and front gripping surface of a modification of the Vpower glove with the hook and loop tape feature for binding the pairs of fingers together to act as one. In these figures, the index finger 2 and the middle finger 3 and the ring finger 4 and the pinky finger 5 are held together by the binding 9 resulting from the hook and loop tape arrangement. Binding the fingers together in this fashion, forces the fingers to act as one, leading to increased grip strength for the wearer of the glove.

The foregoing description of the present invention through its figures and preferred embodiments should not be construed to limit the scope of the invention. It should be understood and obvious to one skilled in the art that the embodiments of the invention thus described may be further modified without departing from the spirit and scope of the invention as set forth in the claims that follow.

What is claimed is:

1. A sports glove with gripping power comprising:

a back surface;

a front gripping surface;

a plurality of glove fingers comprising a thumb glove finger stall, an index glove finger stall, a middle glove finger stall, a ring glove finger stall, and a pinky glove finger stall;

said plurality of glove fingers each having a base end and a top end;

wherein said index glove finger and said middle glove finger stall attached on an exterior surface from said base ends of said glove fingers to said top ends of the said glove fingers and held substantially together to act as one finger;

wherein said ring glove finger stall and said pinky glove finger stall attached on an exterior surface from said base ends of said glove fingers to said top ends of said glove fingers and held substantially together to act as one finger;

wherein said thumb glove finger stall is unattached to said index glove finger stall;

wherein said middle glove finger stall is unattached to said ring glove finger stall; and a wrist strap configured for securing said glove to a wrist.

2. The sports glove of claim 1 wherein the index dove finger stall and the middle glove finger stall are attached to each other from the base ends of said glove fingers to the tops ends of said glove fingers by means of a hook and loop tape arrangement and held substantially together to act as one finger.

3. The sports glove of claim 1 wherein the ring dove finger stall and the pinky glove finger stall are attached to each other from the base ends of said glove fingers to the tops ends of said glove fingers by means of a hook and loop tape arrangement and held substantially together to act as one finger.

4. The sports glove of claim 1 wherein the index glove finger stall and the middle glove finger stall are attached to each other from the base ends of said glove fingers to the top ends of said glove fingers by means of stitches and held substantially together to act as one finger.

5. The sports glove of claim 1 wherein the ring glove finger stall and the pinky glove finger stall are attached to each other from the base ends of said fingers to the top ends of said glove fingers by means of stitches and held substantially together to act as one finger.

6. The sports glove of claim 1 wherein the thumb glove finger stall and the index glove finger stall are separated from each other and not attached to each other by any means to act as one finger.

7. The sports glove of claim 1 wherein the middle glove finger stall and the ring glove finger stall are separated from each other and not attached to each other by any means to act as one finger.

* * * * *